US006074311A

United States Patent [19]

Froud et al.

[11] Patent Number: 6,074,311

[45] Date of Patent: Jun. 13, 2000

[54] DEVICE FOR MARKING THE POSITION OF A GOLF BALL ON THE GROUND

[76] Inventors: Robert John Froud, 1 Victory Court, 23 Marine Parade West, Lee-on-Solent, Hampshire, PO13 9LN, United Kingdom; Giovanni Antonio Nieddu, 14 Mayridge, Titchfield Common, Fareham, Hampshire, PO14 4PQ, United Kingdom

[21] Appl. No.: 09/158,754

[22] Filed: Sep. 22, 1998

[30] Foreign Application Priority Data

Sep. 26, 1997 [GB] United Kingdom ..... 9720368
Aug. 11, 1998 [GB] United Kingdom ..... 9817326

[51] Int. Cl.[7] ..... A63B 57/00

[52] U.S. Cl. ..... 473/406

[58] Field of Search ..... 473/403, 386, 473/285

[56] References Cited

U.S. PATENT DOCUMENTS

| | | | |
|---|---|---|---|
| 3,333,848 | 8/1967 | Budzinski | 473/386 |
| 4,313,604 | 2/1982 | Baxter | 473/386 |
| 4,521,018 | 6/1985 | Cotchonis | 473/406 |
| 5,310,177 | 5/1994 | Conrad et al. | 473/386 |
| 5,356,133 | 10/1994 | Bellagamba | 473/406 |
| 5,403,006 | 4/1995 | Korte-Jungermann | 473/285 |
| 5,417,426 | 5/1995 | Bayer | 273/162 |
| 5,494,279 | 2/1996 | Ahner | 473/386 |
| 5,643,113 | 7/1997 | Rodgers | 473/386 |
| 5,672,121 | 9/1997 | Miller | 473/386 |

*Primary Examiner*—Steven Wong
*Attorney, Agent, or Firm*—Sheridan Ross P.C.

[57] ABSTRACT

A device is disclosed to enable a golfer to mark the position of their ball accurately during a game of golf and/or to replace the ball accurately at the marked position.

In one embodiment, the device comprises: a body which a user can place on the ground in abutment with the ball; a marker pin; and a magnet for releaseably attaching the pin to the body so that the pin projects downwardly, can be driven into the ground adjacent the golf ball and can be released from the device. The device may further include an element operable by the user when the body is on the ground to release the pin from the body so that the user can pick up the body leaving the pin in the ground. In another embodiment (not shown), an element like the element is operable by the user when the body is on the around to drive the pin downwardly into the ground. In a further embodiment, the marker pin can be attached to the device by user operable jaws, rather than by magnetic attraction.

9 Claims, 2 Drawing Sheets

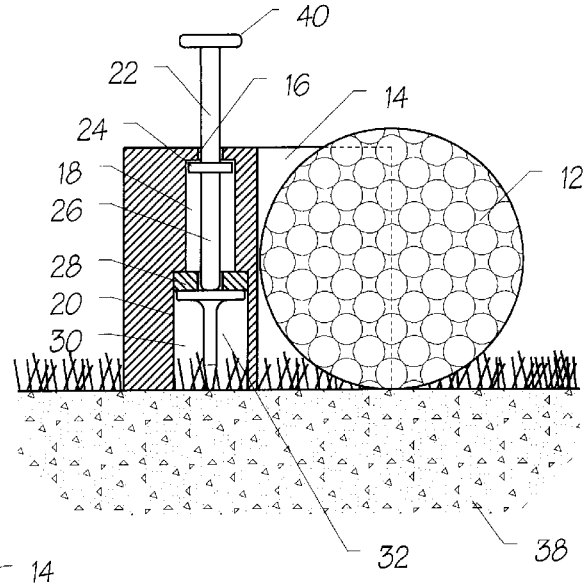
FIG. 5
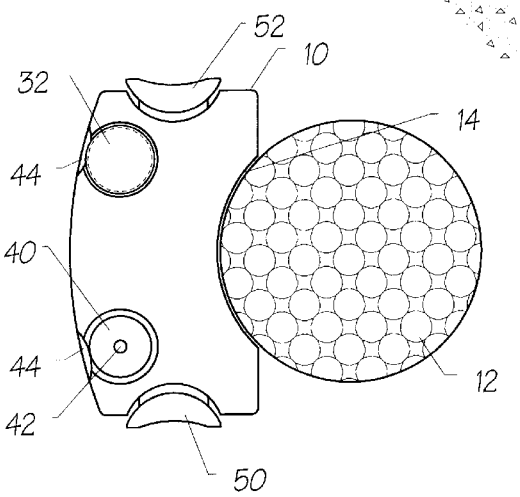
FIG. 6
FIG. 7
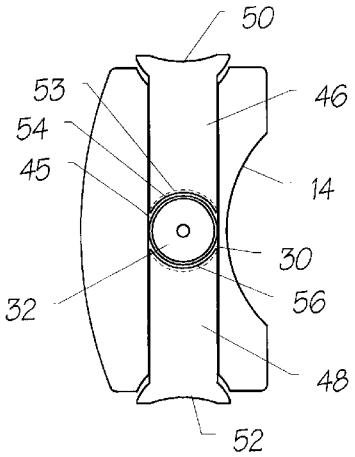
FIG. 8
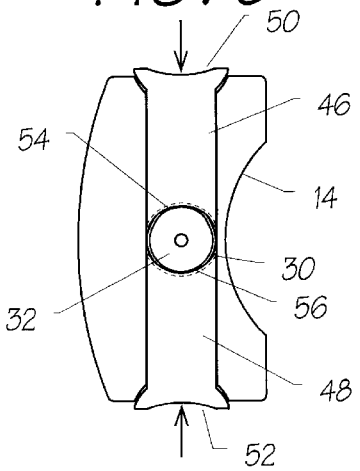

DEVICE FOR MARKING THE POSITION OF A GOLF BALL ON THE GROUND

BACKGROUND OF THE INVENTION

1. Field of the Invention

This invention relates to devices for marking the position of golf balls on the ground.

2. Description of the Prior Art

Usually, in the game of golf, the players take it in turns to play their balls, but the player who is furthest from the hole usually plays first. If the other player's ball may be in the way, that other player would normally mark the position of their ball with a marker, such as a large-headed pin or a coin, remove their ball from the ground until the other ball had been played, and then replace their ball at the marked position ready to play their next shot.

Disputes sometimes arise over whether a player has correctly marked their position and/or whether they have accurately replaced their ball in the marked position.

OBJECTS AND SUMMARY OF THE INVENTION

The present invention is concerned with improving the accuracy with which a player may mark the position of their ball and/or with which they can replace the ball at the marked position.

In accordance with the present invention, there is provided a device for marking the position of a golf ball on the ground, comprising: a body which a user can place on the ground in abutment with the ball; a marker pin; attaching means for releaseably attaching the pin to the body so that the pin projects downwardly, can be driven into the ground adjacent the golf ball and can be released from the device.

The device preferably further includes releasing means operable by the user when the body is on the ground to release the pin from the body so that the user can pick up the body leaving the pin in the ground. Also, the device preferably further includes driving means operable by the user when the body is on the around to drive the pin downwardly into the ground.

Preferably, the attaching means is arranged so that when the user replaces the body on the ground, the marker pin can be re-attached to the body in the predetermined position.

In one embodiment, the attaching means comprises a permanent magnet, and the marker pin is made of a magnetically attractable material. In this case, the releasing means may comprise a member which is operable by the user to separate the pin from the magnet.

In another embodiment, the attaching means comprises jaws which are moveable to engage a head of the marker pin. The jaws and the head of the marker pin preferably have complementary undercuts.

Preferably, the body has a recess to receive the pin to define said predetermined position. Also, the the body preferably has a recess (such as a U-shaped or V-shaped recess) to receive the ball so that the ball can engage the body at at least two positions in the recess.

BRIEF DESCRIPTION OF THE DRAWINGS

FIG. 5 is similar to FIG. 3, but showing a second embodiment of the golf ball marking device;

FIG. 6 is a plan view of a third embodiment of the golf ball marking device and a golf ball;

FIG. 7 is an underplan view of the device of FIG. 6 and a marker pin in a state in which the pin can be released from the device; and FIG. 8 is similar to FIG. 7, but in a state in which the pin is attached to the device.

DETAILED DESCRIPTION OF THE PREFERRED EMBODIMENTS

Figure 1:
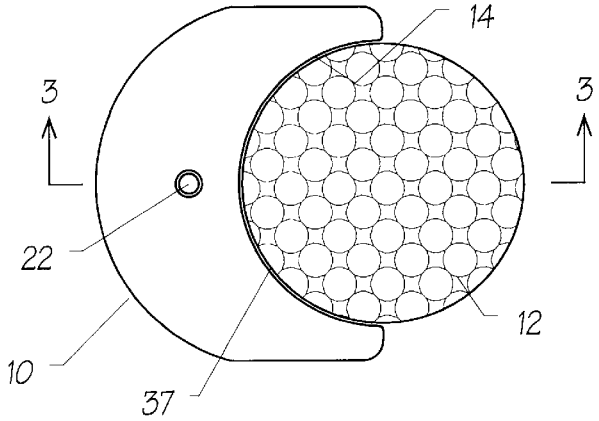
FIG. 1 is a plan view of a first embodiment of the golf ball marking device and a golf ball.
Figure 2:
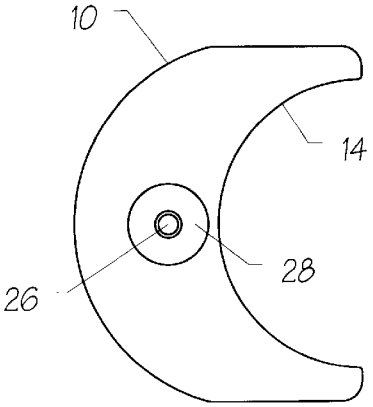
FIG. 2 is an under-plan view of the golf ball marking device.

Specific embodiments of the present invention will now be described, purely by way of example, with reference to the accompanying drawings.

Referring to FIGS. 1 to 4 of the drawings, the first embodiment of the golf ball marking device comprises a body 10, whose height is equal to or greater than the radius of a standard golf ball 12. The body 10 has a recess 14 formed in one side, which as shown in the drawings is semicircular in plan. Alternatively, the recess 14 may be V-shaped in plan. The body 10 has a vertical hole extending through it which is double-counterbored from below so as to have an upper portion 16 of a first diameter, a middle portion 18 of a second diameter greater than the first diameter, and a lower portion 20 of a third diameter greater than the second diameter. An actuator pin is fitted in the hole. The actuator pin has an upper portion 22 which is a sliding fit in the upper portion 16 of the hole, a middle portion 24 which is a sliding fit in the middle portion 18 of the hole, and a lower portion 26 which is of the same diameter as the upper portion 22 of the actuator pin. A cylindrical permanent magnet 28 is a friction fit in, or is glued into, the lower portion 20 of the hole in the body 10, and the magnet 28 has a vertical hole through it in which the lower portion 26 of the actuator pin is a sliding fit. The height of the magnet 28 is less than the height of the lower portion 20 of the hole in the body 10, so that a recess 30 is formed in the lower face of the marking device.

Figure 3:
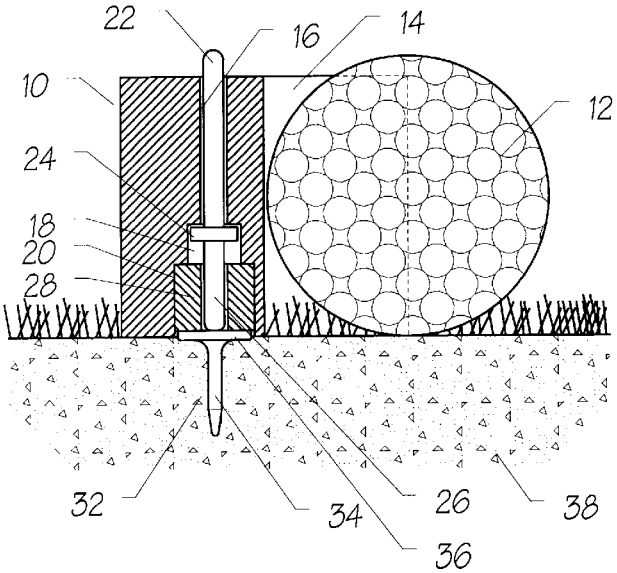
FIG. 3 is a side view of the device, sectioned on the line 3—3 shown in FIG. 1, and the golf ball.
Figure 4:
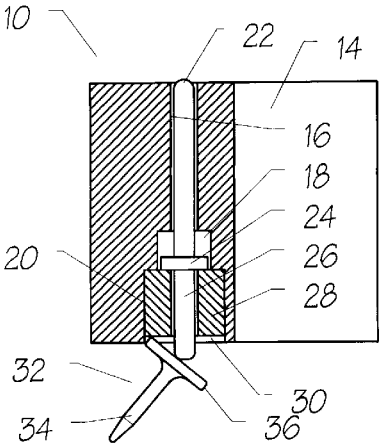
FIG. 4 is similar to the view of the device in FIG. 3, but with a marker pin being released from the device.

The marker pin 32 is formed of a magnetically attractable material and is T-shaped in side view, having a stem 34 and a head 36. The upper surface of the head 36 of the marker pin 32 is flat and has a diameter which is slightly less than the diameter of the recess 30 in the lower face of the marking device. Accordingly, the recess 30 can be positioned over the head 36 of the marker pin 32, as shown in FIG. 3, and when this is done the magnet 28 firmly attaches the marker pin 32 to the body 10 of the marking device in the position defined by the recess 30, and the upper end of the upper portion 22 of the actuator pin projects upwardly from the body 10 of the marking device. If the upper portion 22 of the actuator pin is then depressed by a user, the lower portion 26 of the actuator pin then projects downwardly from the magnet 28 and separates the head 36 of the marker pin 32 from the magnet 28, so that the marker pin 32 falls from the device or is held to it only weakly by its edge, as shown in FIG. 4.

In use, when the user wishes to mark the position of their golf ball 12, they check that the marker pin 32 is attached to the body 10 of the device, and then place the device on the ground 38 with the golf ball 12 engaged in the recess 14 in the side of the body 10, with at least two point contact 37, as shown in FIGS. 1 and 3, and with the body 10 of the device behind the golf ball 12 relative to the direction in which the golf ball 12 will next be played. By pressing downwardly, the marker pin 32 is driven into the ground 38. The golf ball 12 may then be picked up. The user then depresses the upper portion 22 of the actuator pin while picking up the body 10 of the marking device, and the marker pin 32 will thus be separated from the body 10 of the marking device and left in position in the ground 38.

When the user wishes to replace the ball 12, they put the body 10 of the device on the ground 38 so that the head 36 of the marker pin 32 engages in the recess 30 in the underside of the body 10 and with the recess 14 in the side of the body 10 facing the direction of play. Then, they place the golf ball 12 on the ground 38 and in the recess 14 in the side of the body 10. They then pick up the body 10. If strong enough, the magnet 28 may extract the marker pin 32 from the ground; if not, then the user can extract the marker pin 32 by hand. It will therefore be appreciated that the ball will have been replaced in its previous position.

Referring now to the second embodiment shown in FIG. 5, this is generally similar to the first embodiment of FIGS. 1 to 4, except that: (a) the lower portion 20 of the hole in the body is longer, so that the recess 30 in the underside of the body 10 can accommodate substantially the whole length of the marker pin 30; (b) the middle portion 18 of the hole in the body 10 is longer, so that the length of travel of the actuator pin 22,24,26 is longer and approximately equal to the length of the marker pin 30; and (c) a head 40 is fitted to the upper end of the upper portion 22 of the actuator pin.

In use, the marker pin 32 is placed in the recess 30 in the body 10 and is held in place by the magnet 28. The body 10 of the device is then placed on the ground 38 so that the golf ball 12 is engaged in the recess 14 in the side of the body 10, and with the body 10 of the device behind the golf ball 12 relative to the direction in which the golf ball 12 will next be played. The head 40 of the actuator pin is then pushed downwardly so as to drive the marker pin 32 into the ground 38. The body 10 and the golf ball 12 can then be picked up, leaving the marker pin 32 in the ground.

In order to replace the ball 12 in its previous position, the body 10 of the device is placed on the ground 38 so that the head 36 of the marker pin 32 engages in the recess 30 in the underside of the body 10 and with the recess 14 in the side of the body 10 facing the direction of play. The golf ball 12 is then placed on the ground 38 and in the recess 14 in the side of the body 10. The body 10 is then picked up, and the marker pin 32 is extracted by hand from the ground.

Referring now to the third embodiment of the invention shown in FIGS. 6 to 8, the device has a body 10 with a recess 14 to receive a golf ball 12. The top face of the body 10 has a pair of recesses 40 and blind holes 42 (see FIG. 6) in which a pair of marker pins 32 (one of which is shown in FIG. 6) can be placed for storage when not in use. Each recess 40 has a portion 44 opening to the rear edge of the body, in which the user's finger- or thumb-nail can be placed to assist in removing the marker pin 32 from the recess 40/hole 42. Each marker pin 32 is similar to those described above, except that the edge of the head of the pin is undercut at 45 for a reason to be described below, and that the pins 32 are not necessarily made of magnetic material. Indeed the pins 32 in this third embodiment are preferably made of a plastics material so as to reduce not only cost but also the risk of damage to grass-cutting machinery if a pin 32 is lost or left behind on the golf course by the golfer.

Referring in particular to FIGS. 7 and 8, the underside of the body 10 has a transverse channel in which a pair of sliders 46,48 are mounted for movement between the position shown in FIG. 7 and the position shown in FIG. 8 in which the sliders 46,48 are closer together. The sliders are spring-loaded by a spring inside the body 10 towards the FIG. 7 position. The outer ends of the sliders 46,48 have upturned ears 50,52 which can be gripped between the fingers and thumb of the user in order to move the sliders 46,48 to their FIG. 8 position. The inner ends of the sliders 46,48 are arcuate and undercut at 53 to form a pair of jaws 54,56 for the head of the marker pin 32.

In use, in order to mark the position of a golf ball, one of the marker pins 32 is removed from its storage recess 40/hole 42, and the head of the marker pin 32 is placed between the jaws 54,56 of the sliders 46,48 with the stem of the marker pin 32 projecting away from the body 10 of the device. The ears 50,52 are then squeezed so that the jaws 54,56 engage the head of the marker pin 32, the cooperating undercuts 45,53 on the head of the marker pin 32 and the jaws 54,56 providing for positive attachment of the marker pin 32. The device is then placed on the ground behind the ball 12 with the ball 12 positioned against the recess 14 in the body 10 of the device, and the body 10 is pressed downwardly so as to drive the stem of the marker pin 32 into the ground. The pressure on the ears 50,52 is then released so that the device can be taken away, leaving the marker pin 32 in the ground. The ball 12 is then removed.

In order to reposition the ball 12, the device is placed on the ground so that the head of the marker pin 32 enters the recess 30 between the jaws 54,56, and the ball is placed in the recess 14 in the front of the body 10. The ears 50,52 are then squeezed so that the undercut 53 of the jaws 54,56 engages the undercut 45 of the head of the marker pin 32, and the device is then lifted, so withdrawing the marker pin 32 from the ground. The pressure on the ears 50,52 can then be released, and the marker pin 32 removed to its storage recess 40/hole 42.

The above embodiments of the invention have been described purely by way of example, and it will be appreciated that many modifications and developments may be made to them. For example, the embodiment of FIG. 5 may be modified so that the magnet 28 can be independently moved downwardly and used to extract the marker pin 32 from the ground 38. Furthermore, the devices described above may be modified so that two of the marker pins 32 are simultaneously driven into the ground. Accordingly, when it comes to replace the ball, the body 10 can then be engaged with the two pins in one of only two angular positions.

What we claim is:

1. A device for marking the position of a golf ball on the ground, comprising:

a body which a user can place on the ground in abutment with a ball on the ground, the body having a lower surface for en gaging the ground and a recessed side surface for engaging the ball with at least two point contact between the ball and the recessed side surface;

a marker pin; and attaching means for attaching the pin to the body so that the pin can be driven into the ground so that the pin does not project substantially above ground level, with the lower surface of the body engaging the ground and with the recessed side surface engaging the ball, the attaching means being releasable, once the pin has been so driven into the ground, so that the body can be removed from the ground leaving the pin so driven into the ground.

2. A device as claimed in claim 1, further including releasing means operable by the user when the body is on the ground to release the pin from the body so that the user can pick up the body leaving the pin in the ground.

3. A device as claimed in claim 1, further including driving means operable by the user when the body is on the ground to drive the pin downwardly into the ground.

4. A device as claimed in claim 1, wherein the attaching means is arranged so that when the user replaces the body on the ground, the marker pin can be re-attached to the body.

5. A device as claimed in claim 1, wherein the attaching means comprises a permanent magnet, and the marker pin is made of a magnetically attractable material.

6. A device as claimed in claim 2, wherein the attaching means comprises a permanent magnet, the marker pin is made of a magnetically attractable material, and the releasing means comprises a member which is operable by the user to separate the pin from the magnet.

7. A device as claimed in claim 1, wherein the attaching means comprises jaws which are moveable to engage a head of the marker pin.

8. A device as claimed in claim 7, wherein the jaws and the head of the marker pin have complementary undercuts.

9. A device as claimed in claim 1, wherein the body has a recess to receive the pin in a predetermined position.

* * * * *